US008261828B2

(12) United States Patent
Fuhst et al.

(10) Patent No.: US 8,261,828 B2
(45) Date of Patent: Sep. 11, 2012

(54) OPTIMIZED MACHINING PROCESS FOR CUTTING TUBULARS DOWNHOLE

(75) Inventors: Karsten Fuhst, Hannover (DE); Sven Krueger, Winsen (DE)

(73) Assignee: Baker Hughes Incorporated, Houston, TX (US)

( * ) Notice: Subject to any disclaimer, the term of this patent is extended or adjusted under 35 U.S.C. 154(b) by 378 days.

(21) Appl. No.: 12/541,035

(22) Filed: Aug. 13, 2009

(65) Prior Publication Data

US 2009/0294127 A1 Dec. 3, 2009

Related U.S. Application Data

(63) Continuation-in-part of application No. 11/728,461, filed on Mar. 26, 2007, now Pat. No. 7,628,205.

(51) Int. Cl.
*E21B 29/00* (2006.01)

(52) U.S. Cl. ..... 166/298; 166/55.7

(58) Field of Classification Search ..... 166/55, 166/55.1, 55.7, 55.8, 298; 175/230
See application file for complete search history.

(56) References Cited

U.S. PATENT DOCUMENTS

| | | | | |
|---|---|---|---|---|
| 1,471,526 | A | 10/1923 | Pickin | |
| 1,476,481 | A | 12/1923 | Bashara et al. | |
| 1,923,487 | A | 8/1933 | Howard et al. | |
| 1,945,160 | A | 1/1934 | Pearce | |
| 2,357,835 | A | 9/1944 | Leissler | |
| 2,482,674 | A * | 9/1949 | Kriegel | 166/55.8 |
| 2,690,897 | A | 10/1954 | Clark, Jr. | |
| 3,606,924 | A | 9/1971 | Malone | |
| 5,014,780 | A | 5/1991 | Skipper | |
| 5,018,580 | A * | 5/1991 | Skipper | 166/298 |
| 5,179,781 | A | 1/1993 | Weaver | |
| 5,477,759 | A | 12/1995 | Robinson | |
| 5,678,466 | A | 10/1997 | Wahl | |
| 6,056,072 | A | 5/2000 | Koltermann et al. | |
| 6,568,489 | B1 | 5/2003 | Bailey | |
| 6,868,901 | B2 | 3/2005 | Mason et al. | |
| 2001/0001935 | A1 | 5/2001 | Wilk, Jr. et al. | |
| 2001/0045146 | A1 | 11/2001 | Fisher et al. | |
| 2002/0060073 | A1 | 5/2002 | Dewey et al. | |
| 2003/0070812 | A1 | 4/2003 | Robertson | |
| 2003/0159826 | A1 | 8/2003 | Ohmer | |
| 2004/0045714 | A1 | 3/2004 | McGavern, III et al. | |
| 2004/0089478 | A1 | 5/2004 | Cruickshank et al. | |
| 2004/0140090 | A1 | 7/2004 | Mason et al. | |
| 2005/0023044 | A1 | 2/2005 | Schuffenhauer et al. | |
| 2005/0061551 | A1 | 3/2005 | DeGeare et al. | |
| 2005/0133224 | A1 * | 6/2005 | Ruttley | 166/298 |
| 2005/0145389 | A1 | 7/2005 | Barrow et al. | |
| 2005/0150656 | A1 | 7/2005 | Stowe | |

(Continued)

OTHER PUBLICATIONS

International Search Report for PCT/US08//057591 dated Aug. 20, 2008, 2 pages.

(Continued)

*Primary Examiner* — Hoang Dang
(74) *Attorney, Agent, or Firm* — Bracewell & Guiliani LLP

(57) ABSTRACT

The tubular cutting tool for severing downhole tubulars, the tool having a drive system, a pivoting system, a cutting head, a cutting member, and a lubricant delivery system. Cutting may be accomplished by rotatingly actuating the cutting head with an associated motor and extending the cutting member away from the cutting head. The lubricant delivery system lubricates the respective contacting surfaces of the cutting member and the tubular and is actuated when the cutting member extends from the cutting head.

22 Claims, 10 Drawing Sheets

U.S. PATENT DOCUMENTS

| | | | |
|---|---|---|---|
| 2005/0173123 | A1 | 8/2005 | Lund et al. |
| 2005/0247171 | A1 | 11/2005 | Kawashima |
| 2006/0011344 | A1 | 1/2006 | Lynde et al. |
| 2006/0137877 | A1 | 6/2006 | Watson et al. |
| 2006/0196671 | A1 | 9/2006 | Robichaux |
| 2006/0233619 | A1 | 10/2006 | Kamiyama et al. |
| 2006/0254773 | A1 | 11/2006 | Schlegelmilch et al. |
| 2007/0000696 | A1 | 1/2007 | Laflin |
| 2007/0017708 | A1 | 1/2007 | Radford et al. |
| 2007/0131410 | A1 | 6/2007 | Hill et al. |
| 2007/0181305 | A1 | 8/2007 | McGavern, III et al. |
| 2008/0236830 | A1 | 10/2008 | Fuhst et al. |

OTHER PUBLICATIONS

International Search Report dated Apr. 20, 2011 (9 pages).
Written Opinion of the International Preliminary Examining Authority, Oct. 24, 2011, 4 pages.

* cited by examiner

OPTIMIZED MACHINING PROCESS FOR CUTTING TUBULARS DOWNHOLE

CROSS REFERENCE TO RELATED APPLICATIONS

This application is a continuation-in-part of and claims priority from co-pending U.S. Application having Ser. No. 11/728,461, filed Mar. 26, 2007, the full disclosure of which is hereby incorporated by reference herein.

BACKGROUND OF THE INVENTION

1. Field of the Invention

The disclosure herein relates generally to the field of severing a tubular member. More specifically, the present disclosure relates to an apparatus for cutting downhole tubulars. Yet more specifically, described herein is a method and apparatus for optimizing cutting tubulars wherein lubrication is maintained between the cutting member and the tubular.

2. Description of Related Art

Tubular members, such as production tubing, coiled tubing, drill pipe, casing for wellbores, pipelines, structural supports, fluids handling apparatus, and other items having a hollow space can be severed from the inside by inserting a cutting device within the hollow space. As is well known, hydrocarbon producing wellbores are lined with tubular members, such as casing, that are cemented into place within the wellbore. Additional members such as packers and other similarly shaped well completion devices are also used in a wellbore environment and thus secured within a wellbore. From time to time, portions of such tubular devices may become unusable and require replacement. On the other hand, some tubular segments have a pre-determined lifetime and their removal may be anticipated during completion of the wellbore. Thus when it is determined that a tubular needs to be severed, either for repair, replacement, demolishment, or some other reason, a cutting tool can be inserted within the tubular, positioned for cutting at the desired location, and activated to make the cut. These cutters are typically outfitted with a blade or other cutting member for severing the tubular. In the case of a wellbore, where at least a portion of the casing is in a vertical orientation, the cutting tool is lowered into the casing to accomplish the cutting procedure.

BRIEF SUMMARY OF THE INVENTION

Disclosed herein is a cutting tool and method wherein lubrication is delivered during cutting. The system employs a rotating blade and a lubrication system for dispensing lubrication between the blade's cutting surface and the tubular to be cut. Optionally an isolation material may be included for retaining the lubrication in the cutting region. An example of a cutting tool includes a housing, a cutting member having a stowed position within the housing and a cutting position in cutting contact with the tubular, lubricant stored in a reservoir in the housing, a lubricant dispensing system having an inlet in fluid communication with the reservoir, an exit on the lubricant dispensing system that is sealed when the cutting member is in the stowed position, and open when the cutting member is in the cutting position, so that when the cutting member is in the cutting position lubricant can flow from the reservoir, through the lubricant dispensing system, and from the exit into the space between the cutting member and the downhole tubular. The cutting tool may optionally have a pressure source in pressure communication with the lubricant in the reservoir, so that when the exit on the lubricant dispensing system is open the lubricant is urged from the reservoir and out the exit. The cutting tool can also further include isolation material in a reservoir in the housing, a selectively openable passage between the reservoir and annulus between the cutting tool and the tubular, so that when the passage is opened the isolation material flows from the reservoir into the annulus to form a barrier hindering the lubricant from flowing away from the area where the cutting member contacts the tubular. A conduit may be in the cutting tool between the inlet and exit; also included can be a fastener coaxially coupled with the cutting member, wherein the exit mates with the fastener when the cutting member is in the stowed position to form a seal at the exit, and when the cutting member is in the cutting position the fastener is moved away from the exit thereby removing the seal from the exit allowing lubricant to flow through the conduit and out of the exit. A sealing plug may be slidingly disposed within the conduit that forms a seal in the conduit along its length and is pushed from the conduit by the lubricant when the seal is removed. The lubricant dispensing system can be a frangible conduit having an inlet in fluid communication with the reservoir, wherein the conduit is positioned so that when the cutting member moves from its stowed position to its cutting position it cutting contacts the frangible conduit to form an opening for lubricant to exit. Alternatively, the lubricant dispensing system includes a conduit depending from the exit, a sealing surface in the conduit, a seal element in the conduit in selective sealing engagement with the sealing surface, a portion of the seal element protruding past the exit and in the cutting member path as it moves from its stowed to cutting position, so that when the cutting member moves into its cutting position it contacts the seal element to push it away from the sealing surface to provide a fluid communication path between the reservoir and the exit. The cutting tool can be suspended from the surface on a conveyance member attached to the housing; a motor may be included in the housing coupled to the cutting member, and an anchor can be coupled with the housing having a deployed position in anchoring contact with the tubular. An electrical power supply can be provided at the surface connected to the conveyance member and a conducting member included between the conveyance member and the motor, so that power from the electrical power supply powers the motor.

Also disclosed herein is a method of cutting a downhole tubular that includes providing a tubular cutting device that includes a body, a cutting member moveable along a path from a stowed position within the body to a cutting position outside of the body, a supply of lubricant in the body, a lubricant dispensing system in fluid communication with the lubricant having a selectively openable exit, deploying the cutting device within the tubular; contacting the portion of the dispensing system with the cutting member by moving the cutting member from the stowed position to the cutting position, selectively opening the dispensing system exit with the cutting member so that lubricant flows from the exit and in the space adjacent the portion of the tubular to be cut, rotating the cutting member, and contacting the tubular with the rotating cutting member with the lubricant between the cutting member and the tubular.

DETAILED DESCRIPTION OF THE INVENTION

Figure 1:
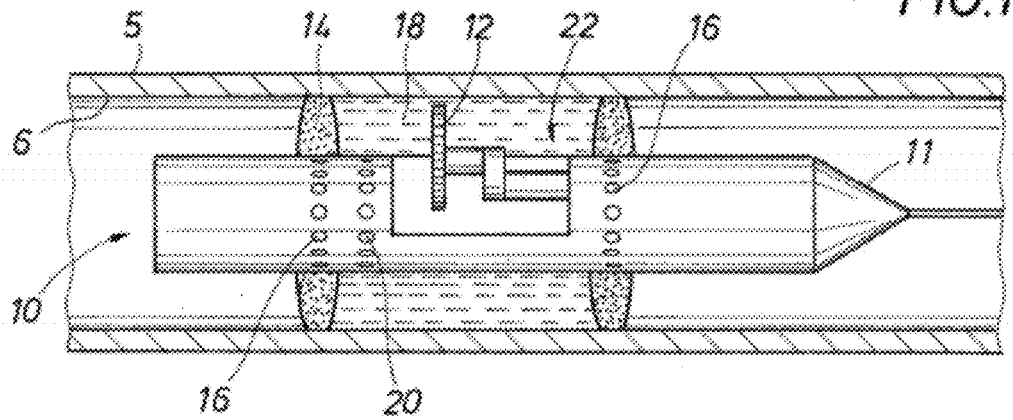
FIG. 1. is a side view of an embodiment of a cutting tool in a tubular.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be through and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

Described herein is a method and apparatus for cutting and severing a tubular. While the apparatus and method described herein may be used to cut any type and length of tubular, one example of use involves severing tubing disposed within a wellbore, drill pipe, wellbore tubular devices, as well as wellbore casing. One embodiment of a cutting tool 10 as described herein is shown in side partial cut away view in FIG. 1. In this embodiment, the cutting tool 10 comprises a body 11 disposed within a tubular 5. As noted, the tubular 5 may be disposed within a hydrocarbon producing wellbore, thus in the cutting tool 10 may be vertically disposed within the wellbore tubular. Means for conveying the cutting tool 10 in and out of the wellbore include wireline, coiled tubing, slick line, among others. Other means may be used for disposing the cutting tool 10 within a particular tubular. Examples of these include drill pipe, line pigs, and tractor devices for locating the cutting tool 10 within the tubular 5.

Included within the body 11 of the cutting tool 10 is a cutting member 12 shown pivotingly extending out from within the body 11. A lubricant 18 is shown (in cross hatch symbology) disposed in the cutting zone 22 formed between the outer surface of the tool 10 and the inner surface 6 of the tubular 5. For the purposes of discussion herein, the cutting zone 22 is designed as the region on the inner circumference of the tubular, as well as the annular space between the tool and the tubular proximate to the portion of the tubular that is being cut by the cutting tool. Examples of lubricants include hydrogenated polyolefins, esters, silicone, fluorocarbons, grease, graphite, molybdenum disulfide, molybdenum sulfide, polytetrafluoroethylene, animal oils, vegetable oils, mineral oils, and petroleum based oils.

Lubricant 18 inserted between the cutting member 12 and the inner surface 6 enhances tubular machining and cutting. The lubricant 18 may be injected through ports or nozzles 20 into the annular space between the tool 10 and the tubular 5. These ports 20 are shown circumferentially arranged on the outer surface of the tool housing 11. The size and spacing of these nozzles 20 need not be arranged as shown, but instead can be fashioned into other designs depending upon the conditions within the tubular as well as the type of lubricant used. As discussed in more detail below, a lubricant delivery system may be included with this device for storing and delivering the lubricant into the area between the cutting member and the tubular inner surface 6. In many situations when disposing a cutting tool within a tubular, especially a vertically oriented tubular, lubricants may be quickly drawn away from where they are deposited by gravitational forces. Accordingly, proper lubrication during a cutting sequence is optimized when lubrication is maintained within the confines of the cutting zone 22.

Additional ports 16 are shown disposed on the outer surface of the housing 11 for dispensing an isolation material 14 into the space between the tubular 5 and the tool 10. The lubricant port 20 location with respect to the isolation port 16 location enables isolation material 14 to be injected on opposing sides of the lubricant 18. Isolation material 14 being proximate to and/or surrounding the lubricant 18 retains it within or proximate to the cutting zone 22. Referring again to FIG. 1, isolation material 14 is disposed in the annular space between the tool 10 and the tubular 5 and on opposing ends of the lubricant 18. Thus the isolation material should possess sufficient shear strength and viscosity to retain its shape between the tool 10 and the tubular and provide a retention support for the lubricant 18.

Examples of isolation materials include a gel, a colloidal suspension, a polysaccharide gum, xanthan gum, and guar gum. One characteristic of suitable isolation material may include materials that are thixotropic, i.e. they may change their properties when external stresses are supplied to them. As such, the isolation material should have a certain amount of inherent shear strength, high viscosity, and surface tension in order retain its form within the annular space and provide a retaining force to maintain the lubricant in a selected area. Thus, as shown in FIG. 1, the presence of the isolating material on opposite sides of the lubricant helps retain the lubricant within the cutting zone.

Figure 2:
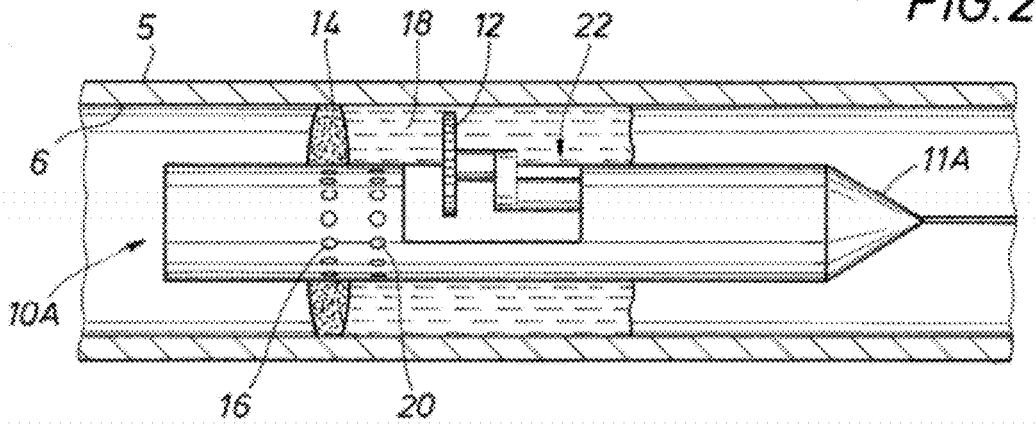
FIG. 2 is a side view of an alternative embodiment of a cutting tool in a tubular.

An alternative embodiment of a cutting tool 10A within a tubular 5 is provided in side partial cross sectional area in FIG. 2. In this embodiment, nozzles 16 are shown circumscribing the body 11A outer surface along a single axial location on the tool 10A. Optionally, in this situation, the nozzles 16 could be disposed on a side of the lubrication nozzles 20 opposite the cutting member 12.

Figure 3:
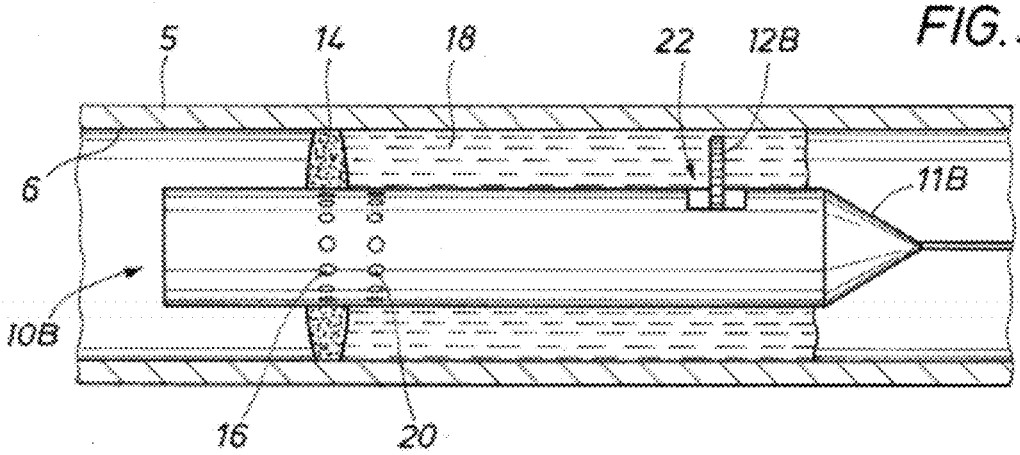
FIG. 3 is a side view of an alternative embodiment of a cutting tool in a tubular.

Shown in a side partial sectional view in FIG. 3 is another embodiment of a cutting tool 10B coaxially deployed within a tubular 5. In this embodiment the cutting member 12B is a straight blade affixed to a portion of the body 11B. Although in this embodiment a single set of nozzles 16 is shown for disposing isolation material 14 into the annular space between the cutting tool 10B and the inner surface 6 of the tubular 5, multiple sets of nozzles can be included with this embodiment along the length of the cutting tool 10B. As shown, the lubricant 18 has been injected into the tubular 5 between the tool 10B and the tubular inner surface 6. Thus, the cutting zone 22 includes lubrication for enhancing any machining or cutting by the tool 10B. Isolation material 14 is also injected into the annular space between the tool 10B and the tubular thereby providing a retaining support for the lubricant 18.

Figure 4A:
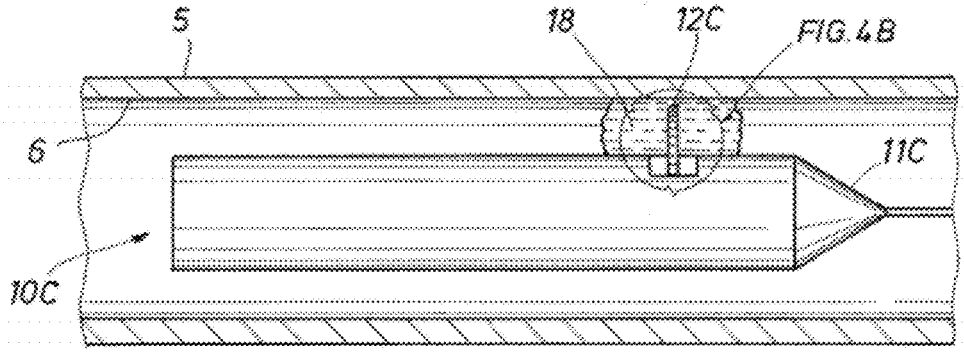
FIG. 4*a* is a side view of a cutting tool having a lubrication system.
Figure 4B:
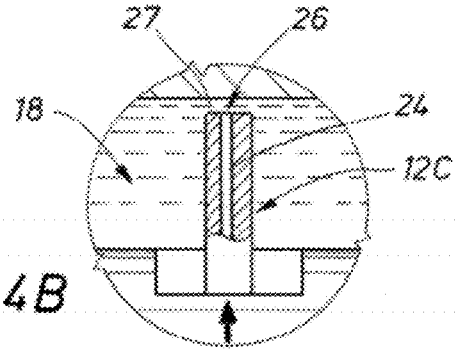
FIG. 4*b* is a magnified side view of a cutting tool with a lubrication system.

Another embodiment for delivering lubrication to a cutting surface is provided in FIGS. 4A and 4B. Here an example is provided of delivering a lubricant 18 to the cutting surface of a cutting blade by installing conduits within the blade itself. Shown in side partial sectional view in FIG. 4A is a cutting tool 10C within a tubular 5 having a blade like cutting member 12C radially extending from the body 11C. Rotating the cutting tool 10C while urging the cutting member 12C into contact with the inner surface 6 cuts into the tubular 5, and eventually severs the tubular 5. Lubricant 18 is provided within a lubricant reservoir (not shown) disposed in the body 11C. The reservoir is in fluid communication with the cutting member 12C via supply line 24 shown extending into the cutting member 12C. Lubricant 18 flows from the reservoir through the supply line 24 and exits the cutting member 12C through a nozzle exit 26 formed at the supply line 24 terminal end. When discharged from the supply line 24, the lubricant 18 enters the annular space between the cutting member 12C and the inner surface 6. This places the lubricant 18 on the cutting surface 27 of the cutting member 12C reducing cutting friction thereby enhancing cutting operations. Lubricant 18 may be constantly supplied out into the nozzle exit 26 during a tubular 5 cutting procedure.

Figure 5:
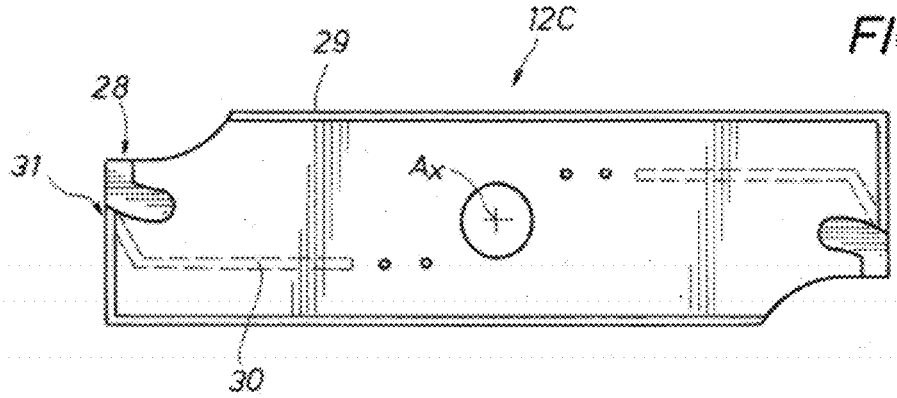
FIG. 5 is an overhead view of a cutting blade having lubrication delivery ducts.

FIG. 5 provides an overhead view of one example of a cutting member 12C that includes a blade 29 having conduits formed within its surface for delivering lubricant 18 to a cutting surface. In this embodiment, the cutting member 12C includes inlays 28 on the blade 29. Rotating the blade 29 about its axis $A_X$ and contacting a tubular with the moving inlays 28 can cut and sever a tubular. Lubricant supply lines 30, shown in dashed outline, extend linearly along the blade 29 in opposite directions from the blade axis $A_X$. The supply lines 30 terminate at exit nozzles 31 proximate each inlay 28. Optimization of machining or cutting a tubular can occur by injecting lubricant from the exit nozzles 31 so lubricant is on the cutting surface during cutting. Optionally a nozzle could be formed on an inlay 28 so that lubricant 18 is added during the entire cutting sequence and is present between the cutting blade 29 and the cutting surface. For the purposes of discussion herein, cutting surface can be a surface in cutting contact, this includes the tubular inner surface 6 where it is being contacted by a cutting member as well as any portion of a cutting member or blade contacting a tubular during cutting.

Figure 6:
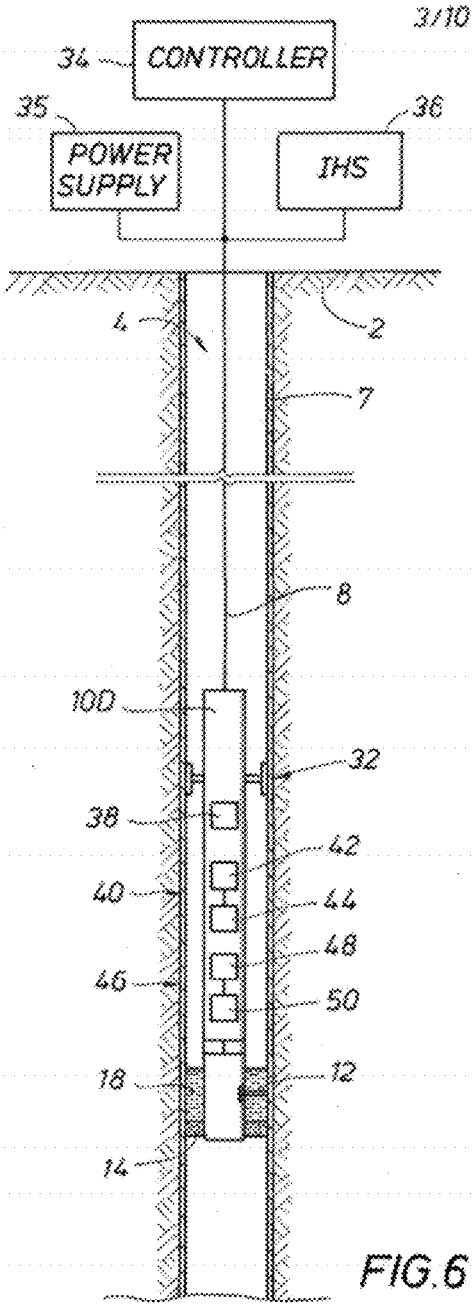
FIG. 6 is a partial cut away view of a cutting tool disposed in a cased wellbore.

FIG. 6 provides a partial side cut away view of an embodiment of a cutting system used in cutting a tubular 7. In this embodiment a cutting tool 10D is shown deployed from a conveyance member 8 into a cased wellbore 4 that intersects a subterranean formation 2. The tubular 7 is coaxially disposed within the wellbore casing. Optionally, the cutting tool 10D may be employed for cutting the wellbore casing and used in the same fashion it is used for cutting the tubular 7. Examples of means used in deploying the tool 10D in and out of the wellbore 4 by the conveyance member 8 include wireline, slick line, coil tubing, and any other known manner for disposing a tool within a wellbore. Shown included with the cutting tool 10D is a controller 38, a lubricant delivery system 40, an isolation material delivery system 46, and a cutting member 12. The controller 38, which may include an information handling system, is shown integral with the cutting tool 10D and may be used for its control. The controller 38 may be configured to have preset commands stored therein, or can receive commands offsite or from another location via the conveyance member 8. An optional anchoring system 32 is shown having anchor legs extending outward from the cutting tool 10D into anchoring contact with the tubular 7 inner surface.

The lubricant delivery system 40 can be employed to deliver lubricant 18 within the space between the cutting member 12 and tubular 7. The delivery system 40 shown includes a lubricant pressure system 42 in communication with a lubricant reservoir 44. The pressure system 42 is adapted for conveying lubricant 18 from within the reservoir 44 through the tool 10D and into the annular space between the cutting tool 10D and the tubular 7 and adjacent the cutting member 12. The pressure system 42 may be spring loaded, a motor driven pump, or include pressurized gas.

Further depicted with the cutting tool 10D of FIG. 6 is an isolation material pressure supply 48 and an isolation material reservoir 50 that are included with the isolation material delivery system 46. The isolation material pressure supply 48, which can have a pump, spring loaded device, or compressed gas, may be used in urging isolation material 14 from within the isolation material reservoir 50 and out into the annular space between the tool 10D and the tubular 7. It should be pointed out that the isolation material 14 and lubricant 18 can be simultaneously ejected from the cutting tool 10D. Optionally either the isolation material 14 or lubricant 18 may be delivered into the annular space before the other in sequential or time step fashion. As far as the amount of lubricant 18 or isolation material 14 delivered, it depends on the cutting tool 10D and/or tubular 7 dimensions; it is believed it is well within the capabilities of those skilled in the art to design a system for delivering a proper amount of lubricant 18 as well as isolation material 14.

As shown with the embodiment of FIG. 6, the cutting member is in a cutting sequence for cutting the tubular 7 and isolation material 14 is shown retaining a quantity of lubricant 18 adjacent the cutting member 12 thereby maintaining the lubricant 18 in the space between the cutting member and the tubular 7. A controller 34 disposed at surface may be employed for relaying commands to or otherwise controlling the cutting tool 10D. The controller 34 may be a surface truck (not shown) disposed at the surface as well as any other currently known or later developed manner of controlling a wellbore tool from the surface. Included optionally is an information handling system 36 that may be coupled with the controller 34 either in the same location or via some communication either wireless or hardwire. Also illustrated schematically is a power supply 35 shown disposed on the surface above the wellbore 4 and in communication with the conveyance member 8. The power supply 35 can selectively provide power to the cutting tool 10D via the conveyance member 8 that can be used for controls and/or motors within the tool 10D.

It should be pointed out that the exit nozzles can have the same cross sectional area as the supply lines leading up to these nozzles, similarly other types of nozzles can be employed, such as a spray nozzle having multiple orifices, as well as an orifice type arrangement where the cross sectional area at the exit is substantially reduced to either create a high velocity stream or to atomize the lubricant for more dispersed application of a lubricant.

Figure 7:
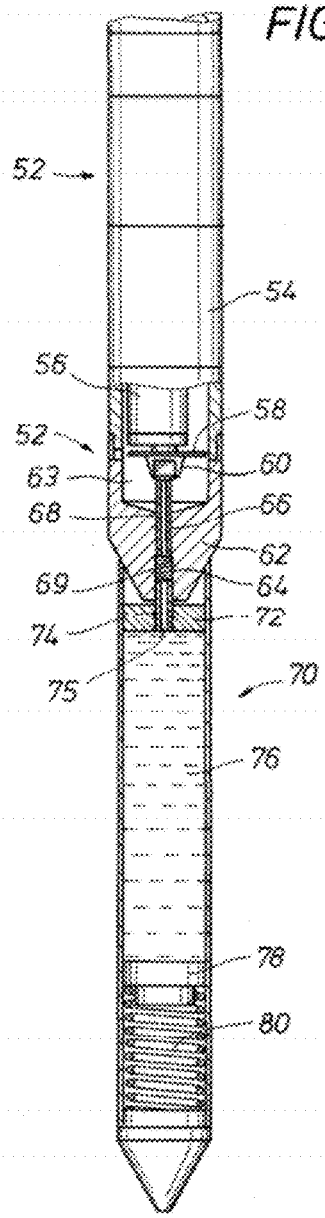
FIG. 7 depicts in a perspective view a cutting tool with a lubricant sub.

Referring now to FIG. 7, provided therein is a side perspective and partial sectional view of an embodiment of a cutting tool 52. The cutting tool 52 shown is a generally elongated member having a cylindrical outer body or housing 54. Within the housing 54 is a motor 56 coupled to a circular cutting member 58 on its lower end. A fastener 60 couples on the cutting member 58 lower surface coaxial with the cutting tool 52. The fastener 60 may be a nut that is screwed onto a shaft (not shown) extending from the motor 56. Optionally, a gearing system (not shown) may mechanically connect the motor 56 and cutting member 58.

Below the cutting member 56 the housing 54 tapers into a frusto-conical section to define a nose portion 62. A bore 64 is shown axially formed through the nose portion 62 and in alignment with the fastener 60. A cylindrically shaped nozzle 66 is disposed in the bore 64 having an upper end in contact with the fastener 60 lower surface. The nozzle 66 lower most end juts into a cylindrically shaped lubricant sub 70 that is attached along the conically contoured nose portion 62 outer surface. The lubricant sub 70 is shown in sectional view as a generally hollow member having on its upper end a cylindrically shaped plug 72 that abuts the nose portion 62 lower end. A ferrule 74 shown coaxially within the plug 72 registers with a passage 68 coaxially formed through the nozzle 66. A reservoir 76 is defined within an open space in the sub 70 that is below the plug 72. Lubricant may be stored in the reservoir 76 for injection between the cutting member 58 and a tubular inner surface. As noted above, injection of the lubricant onto a cutting surface enhances the cutting deficiency of a cutting tool.

In the embodiment of FIG. 7 a pressure source is provided within the lubricant sub 70 depicted as a combination of a piston 78 and spring 80. The piston 78 illustrated is a cylindrical element defining the reservoir 76 lower periphery. The spring 80, which coils helically along the inner circumference of the sub 70, has a lower end in contact with the lower most surface of a sub 70 in an upper end in contact with the piston 78. Thus as lubricant is expelled from the reservoir 76 the spring 80 expands to urge the piston 76 upwards in the direction of the plug 72. Other pressure means may be employed, such as compressed gas, an expandable bladder, and selectively openable ports adapted to receive wellbore fluid therein.

Figure 8B:
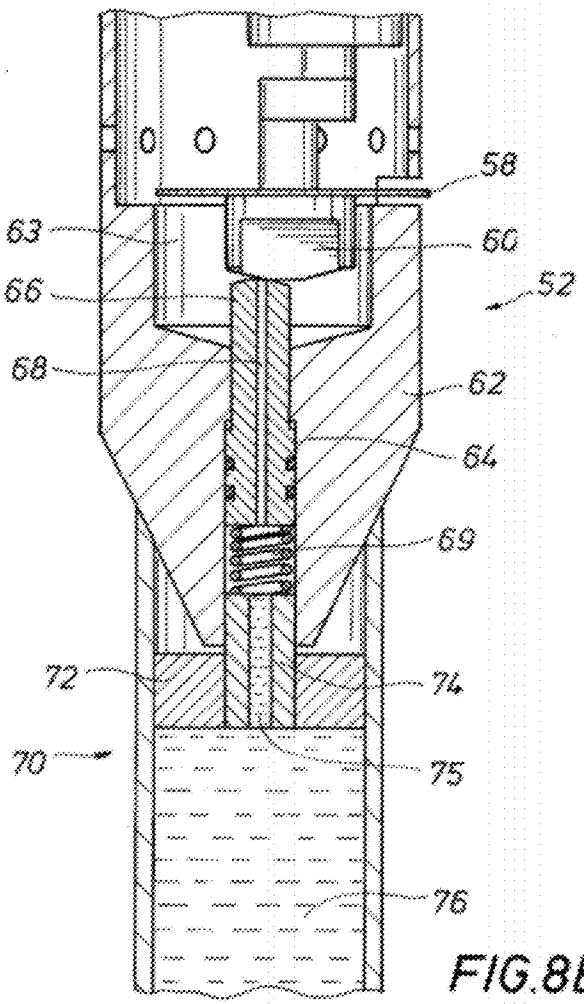
FIGS. 8A, 8B, 9A, and 9B depict in side schematic view a cutting member extending towards a cutting position and opening a discharge port for a lubricant.
Figure 8A:
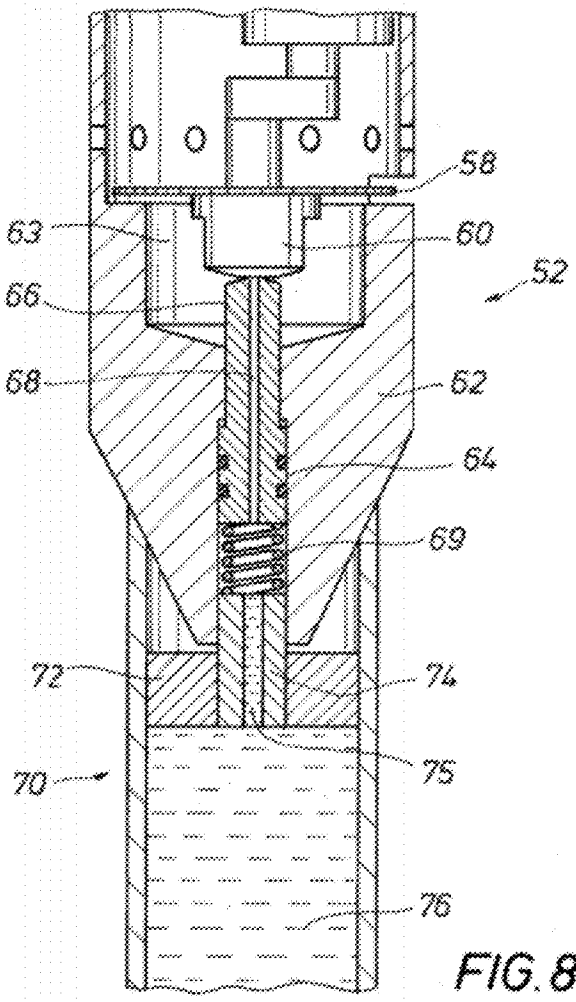

FIGS. 8A and 8B provide an enlarged view of a portion of the cutting tool 52 where it couples with the lubricant sub 70. In these views shown is the passage 68 coaxially formed within the nozzle 66 and how it registers with a dispensing line 75 coaxially formed through the ferrule 74. The combination of the dispensing lines 75 and passage 68 form a conduit adapted for flowing lubricant within the reservoir 76 out into the cutting space between the cutting member 58 in the tubular. More specifically, in FIG. 8A the nozzle 66 upper end is depicted in sealing contact with the fastener 60 bottom blocking the passage 68 exit.

Shown in FIG. 8B the cutting member 58 is moving into a cutting position by pivoting radially outward breaching sealing contact between the fastener 60 and nozzle 66 exit. Therefore lubricant within the reservoir 76 now has a clear path from the nozzle 66 exit and can flow from the reservoir, through the conduit, and out of the nozzle 66 exit. Once past the nozzle 66 exit the lubricant can make its way to between the cutting member 58 and tubular. A resilient member 69 is shown in the space between the nozzle 66 and ferrule 74 that provides an outwardly urging force maintaining the sealing contact between the nozzle 66 exit and fastener 60. In an example the resilient member may be a spring.

Figure 9B:
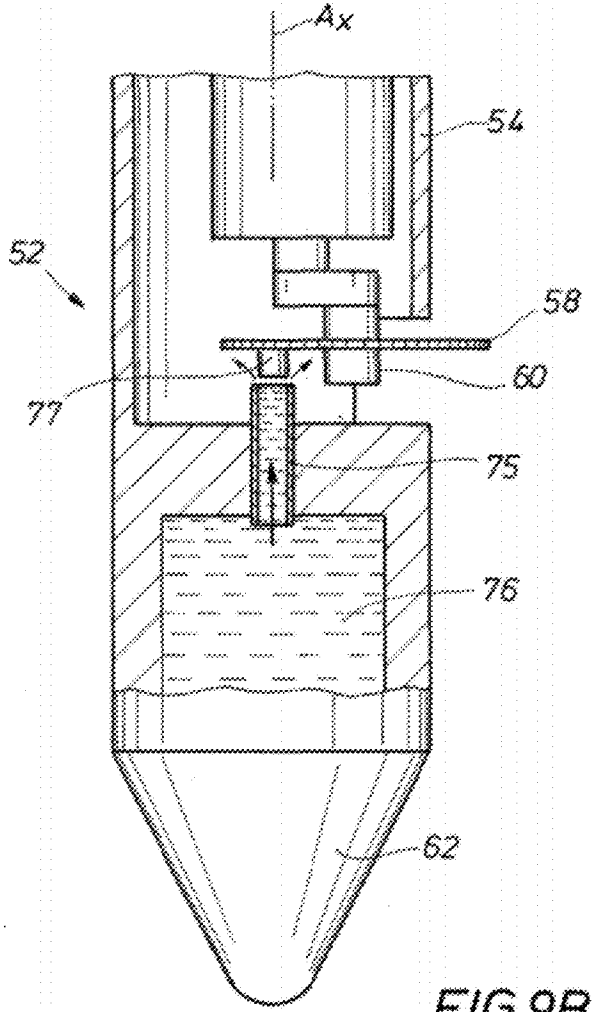
Figure 9A:
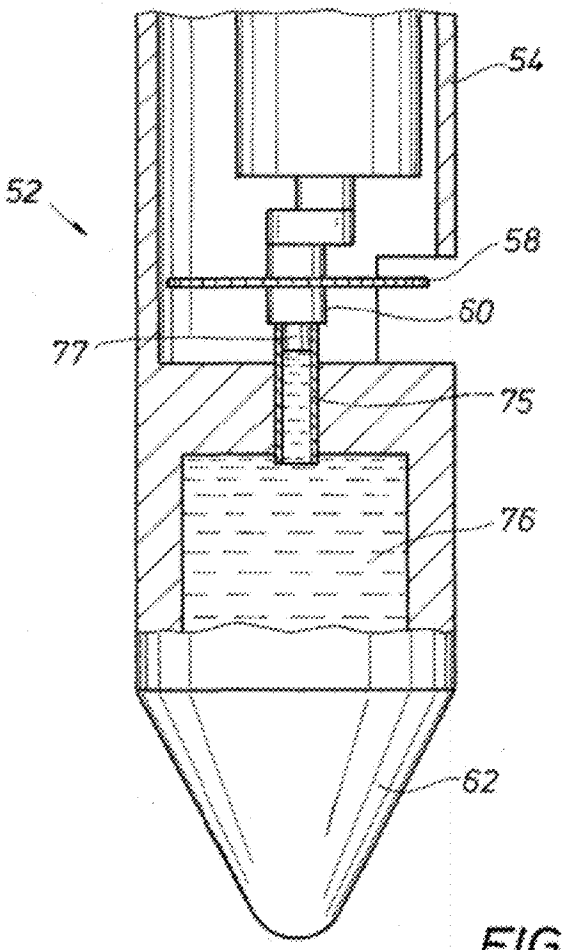

FIGS. 9A and 9B respectively represent side schematic depictions of a cutting member 58 in a stowed position within the housing 54 and in a cutting position in cutting contact with a tubular. The cutting tool 52 embodiments shown in FIGS. 9A and 9B includes a dispensing line 75 representing a conduit for communicating fluid between the reservoir 76 and lubricant exit. The dispensing line 75 exit is shown in sealing contact with the fastener 60 lower surface. Further provided in the embodiments of FIGS. 9A and 9B is a sealing plug 77 slidingly disposed within the dispensing line 75. The presence of the sealing plug 77 enhances the pressure seal between the lubricant within the reservoir 76 and ambient the dispensing line 75. Referring now to FIG. 9B, the cutting member 58 and fastener 60 have moved radially outward from the tool 52 axis $A_X$ thereby removing contact between the exit from the dispensing line 75 and fastener 60. This opens the dispensing line exit 75 allowing the flow of lubricant from the reservoir 76, represented by arrows, through the dispensing line 75 and into the ambient space, where it can make its way or be directed into the space between the cutting element and tubular.

Figure 10:
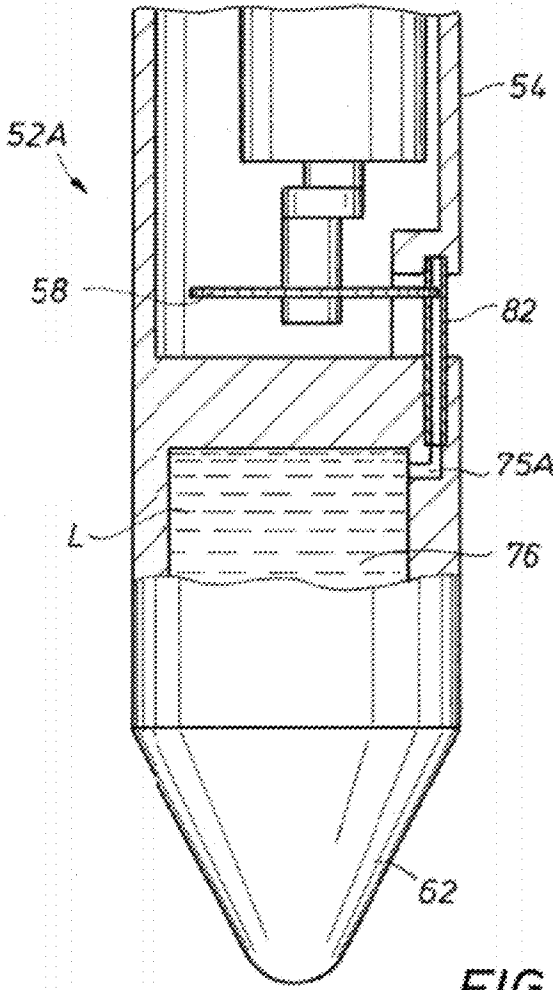
FIG. 10 illustrates a side schematic view of an example of a cutting member moving into contact with a frangible conduit.

A schematic of an alternate cutting tool 52A is provided in a side sectional view in FIG. 10. In this embodiment, a lubricant reservoir 76 within the housing 54 is shown containing lubricant L providing a lubricant supply. A dispensing line 75A provides fluid communication between the lubricant reservoir 76 and a frangible tube 82 shown disposed in the path between the cutting member 58 stowed position and its cutting position. The frangible tube 82 is formed from a material that can be ruptured or otherwise severed by cutting contact with the cutting member 58. Moreover, the frangible tube 82 has a sealed terminal end. In the embodiment of FIG. 10, the end is attached to a solid portion of the body 54. Optionally, the frangible tube 82 can stand freely in the cutting member 58 path and have a closed end rather than attached to the body 54. In the embodiment of FIG. 10, the cutting member 58 which is in cutting rotation, cuts the frangible tube 82 to form an opening. The opening cut into the frangible tube 82 provides an exit for lubricant L within the reservoir 76 to be dispensed into the space outside of the housing 54 and onto the surface of the tubular to be cut by the cutting member 58.

Figure 11:
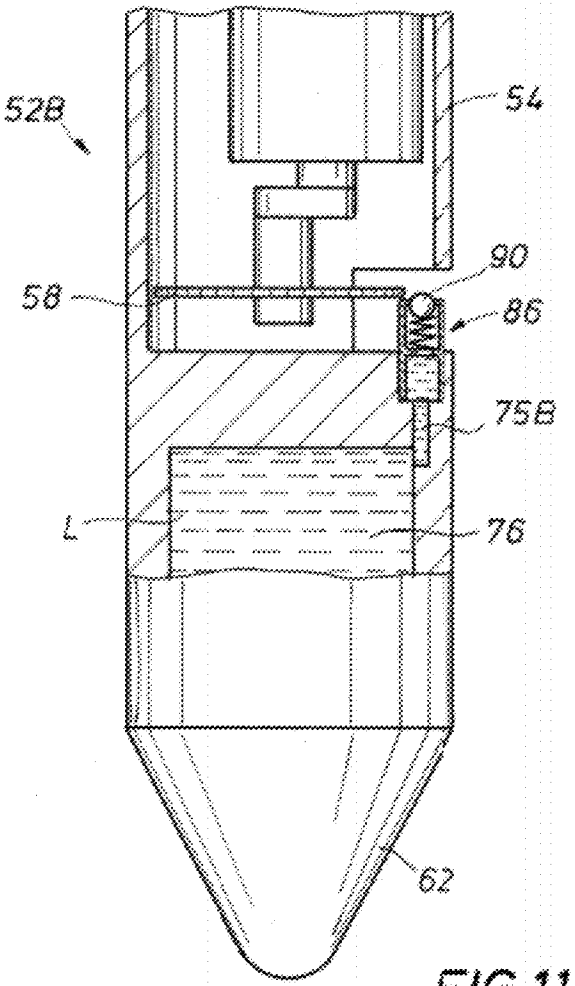
FIGS. 11 and 11A provide side schematic depictions of a cutting member moving into activating contact with a lubricant dispensing system.
Figure 11A:
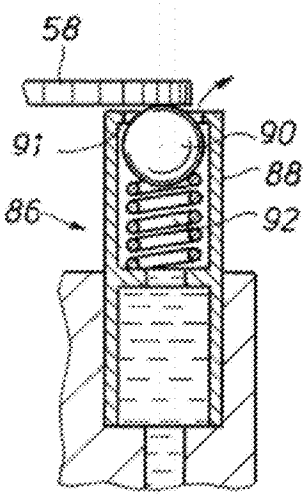

Shown in a side schematic partial sectional view in FIG. 11 is an alternate example of a cutting tool 52B in accordance with the present disclosure. In the embodiment of FIG. 11 a dispensing unit 86 is shown in fluid communication with a dispensing line 75B connected on an upstream end to the lubricant reservoir 76. Contact between the cutting member 58 and a protruding portion of the dispensing unit 86 opens a fluid path between the lubricant reservoir 76 and the area outside the housing 54. FIG. 11A shows in a side sectional view, an enlarged view of the dispensing unit 86 and its interaction with the cutting member 58. The dispensing unit 86 includes a cylindrical hollow outer housing 88, a spherical seal plug member 90 within the housing 88, an annular lip 91 on the exit portion of the housing 88, and a spring 92 in urging contact against the seal plug member 90 on the side opposite the annular lip 91.

Referring back to FIG. 11, a portion of the seal plug member 90 protrudes past the remaining elements in the dispensing unit 86. In this configuration, the seal plug member 90 contacts the inner radius of the annular lip 91 urged upward by the spring 92 to create a sealing surface between the seal plug member and annular lip 91. The dispensing unit 86 shown is configured so that a portion of the seal plug member 90 protrudes into the cutting member 58 path. Thus, as the cutting member 58 moves into its cutting position from its stowed position, it contacts the seal plug member 90 pushing it further inside the housing 88 and depressing the spring 92. This unseats the seal plug member 90 from the annular lip 91 allowing lubricant from within the reservoir 76 to exit from within the housing 54.

Figure 12B:
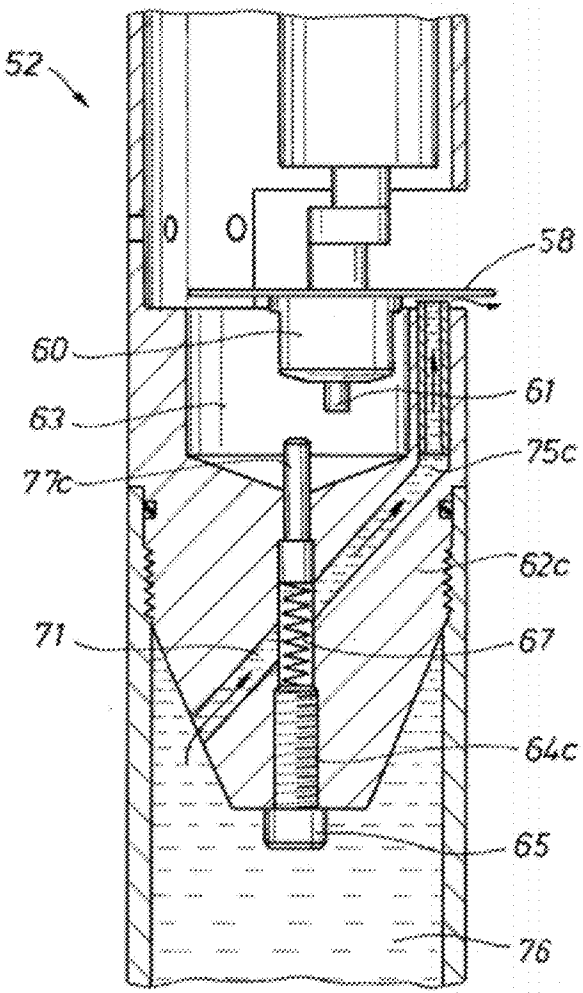
FIGS. 12A and 12B depict in side sectional views an example of a lubricant dispensing system for use with a cutting tool.
Figure 12A:
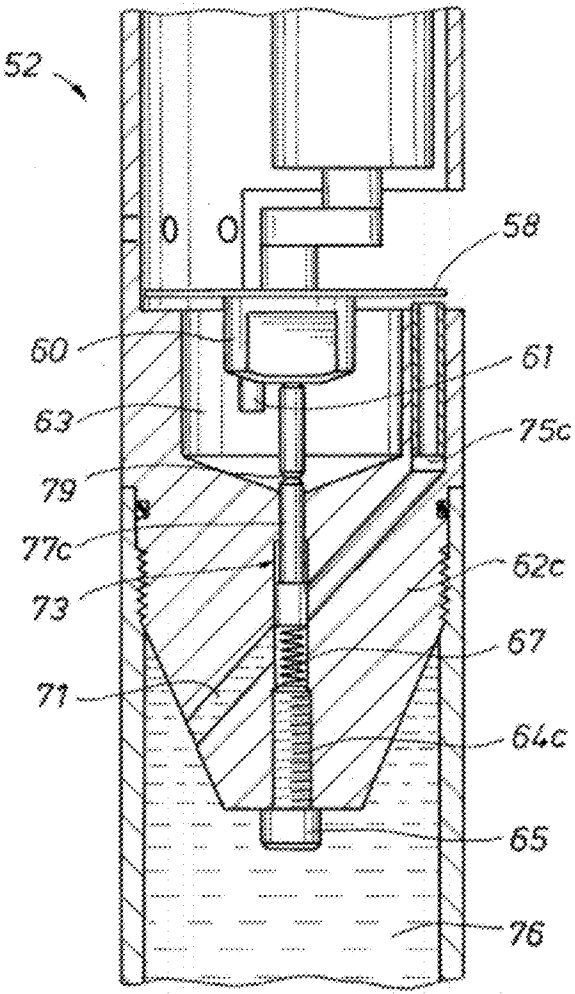
Figure 14A:
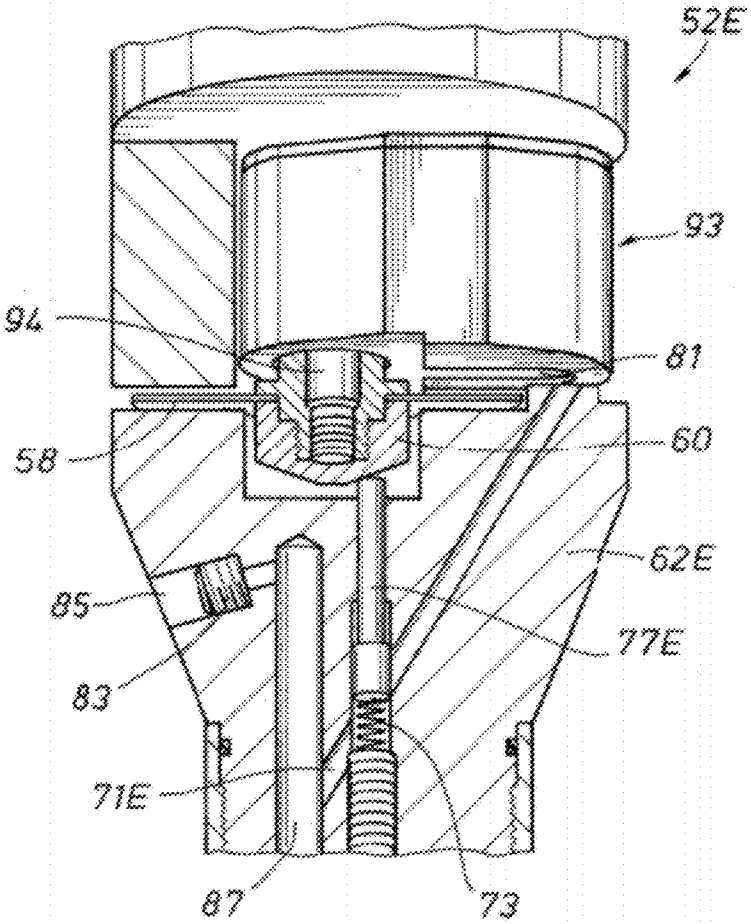
FIGS. 14A-14C and 15A-15B depict in perspective and sectional views an example of a lubricant dispensing system for use with a cutting tool.

Shown in a side sectional view in FIGS. 12A and 12B is another embodiment of a lubricant to cutting surface delivery system. With reference to FIG. 12A, a bore 64C extends through the nose portion 62 between the reservoir 76 and cavity 63 within the cutting tool 52C. A threaded plug 65 is fastened within an end of the bore 64C adjacent the reservoir 76. An elongated piston like sealing plug 77C is slidingly provided within the bore 64C having a portion shown extending outside the bore 64C and into the cavity 63. The sealing plug 77C outer surface is scored on its outer circumference to form a notch 79 and its upper end terminates at the fastener 60 lower surface. An extension 61 is shown depending downward from the fastener 60 lower surface to below the sealing plug 77C upper end.

Both the bore 64C and sealing plug 77C diameters transition from a larger to a smaller diameter. In the configuration of FIG. 12A, the respective diameter transitions are at different locations to form an annular space 73 around a portion of the smaller diameter section of the sealing plug 77C. Also in the bore 64C is a spring 67 shown between the threaded plug 65 and sealing plug 77C that forces the sealing plug 77C upper end against the fastener 60. Also included in this embodiment is a passage 71 bored through the nose portion 64C with an end in fluid communication with the reservoir 76 and an opposite end connecting to the dispensing line 75C. The dispensing line 75C has an exit proximate the cutting member 58. The passage 71 intersects the bore 64C along a portion in which the plug 77C is disposed. In the embodiment of FIG. 12A, a seal is formed along the area where the sealing plug 77C contacts the passage 71 that blocks fluid communication between the reservoir 76 and dispensing line 75C.

As the blade 58 is rotated and pivoted radially outward from the cavity 63, the attached extension 61 collides with the sealing plug 77C and applies a sufficient moment arm to fracture the sealing plug 77C along the notch 79. Referring now to FIG. 12B, removing the portion of the sealing plug 77C above the notch 79, allows the spring 67 to expand and upwardly urge the remaining section of sealing plug 77C. This unseats the seal between the sealing plug 77C and passage 71 thereby allowing lubricating fluid within the reservoir 76 to be communicated through the passage 71, to the dispensing line 75C, and then delivered to a cutting surface. The sealing plug 77C is prevented from being ejected from the bore 64C by contact between the diameter transitions on the bore 64 and sealing plug 77C, thus eliminating the annular space 73.

The present disclosure further includes using a cutting tool with a lubricant to cut tubulars with increased chrome amounts, as well as alloying elements such as nickel, vanadium, molybdenum, titanium, silicium. This method is also applicable to cutting in environments with water, salt water, and drilling fluids.

Figure 13:
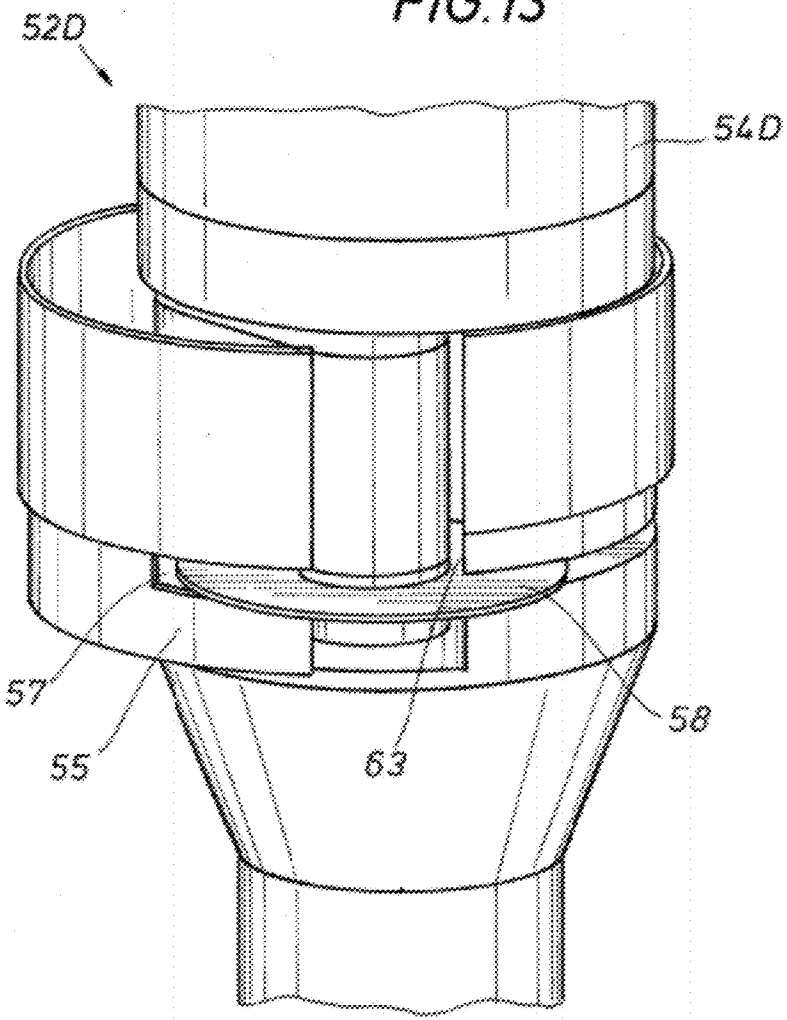
FIG. 13 provides a perspective view of an example of a cutting tool with a cover.

A cover 55 may be provided with an embodiment of the cutting tool 52D for retaining grease within the tool 52D. Shown in perspective view in FIG. 13, the cover 55 envelops a portion of the cavity 63 where the blade 58 is deployed. The cavity 63 can be packed with grease prior to being deployed and the cover 55 put in place thereby retaining the grease in the cavity 63 and on the blade 58 while the tool 52D is being lowered downhole. The cover 55 is shown hinged on an end to the housing 54D so that it can swing open and not impede the blade 58 as it is pivoted radially outward. Selectively opening the cover 55 during cutting enables grease to also migrate to the cutting surface. The cover 55 may be biased, such as with a spring or like member, so that it follows the blade 58 and closes over the cavity 63 as the blade 58 is re-stowed within the housing 54D).

In an optional embodiment shown in FIGS. 14A-15B, grease and/or lubricant from a reservoir on one side of the cutting blade 58 can be dispensed to an opposite side of the blade 58. Shown in a partial sectional perspective in FIG. 14A, a section of the nose portion 62E of the cutting tool 52E projects past the cutting blade 58 having an end terminating at a blade mount 93. The blade mount 93 shown houses a portion of a shaft 94 for rotating the cutting blade 58 and gears for driving the shaft 94. A pivot shaft 95 couples within the blade mount 93, that when rotated pivots the blade mount 93 and blade 58. In the cutting tool 52E example of FIGS. 14A-14C, when the tool 52E is being deployed and the cutting blade 58 is stowed, the sealing plug 77E end opposite the spring 73 is urged against the fastener 60 by the spring 73. Grease and/or lubricant may be introduced into the reservoir 76E via an inlet port 83 disposed in a lateral bore 85 formed radially inward into the nose portion 62E. An axial bore 87 intersects the lateral bore 85 to communicate grease and/or lubricant injected into the port 83 to the reservoir 76E. The lateral bore 85 as shown intersects the passage 71E.

Figure 14C:
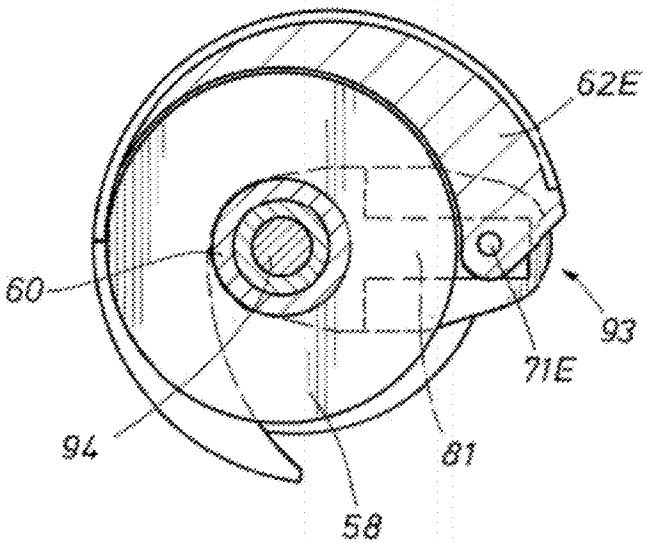
Figure 14B:
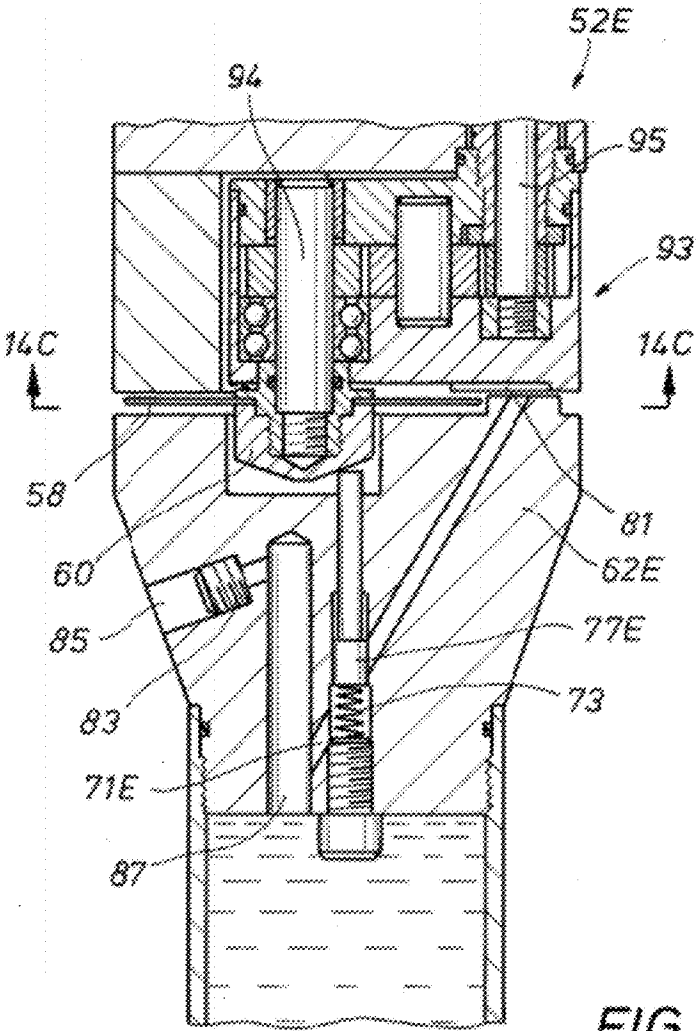

A channel 81 is provided on the blade mount 93 on a side of the cutting blade 58 opposite the reservoir 76E (FIG. 14B). The channel 81 registers with the passage 71E discharge side and extends along the blade mount 93. The other end of the channel 81 terminates between the blade 58 outer periphery and mid section in communication with the side of the blade 58 opposite the reservoir 76E. Thus lubricant and/or grease can be dispensed onto the cutting blade 58 by flowing it from reservoir 76E, into the passage 71E, and through the channel 81. FIG. 14C provides a sectional view of the cutting tool 52E taken along its axis on the reservoir 76C side of the cutting blade 58. The section of the nose portion 62E extending past the blade 58 has a width that tapers along its circumference thereby forming a crescent shape. The wider section of the nose portion 62E is disposed proximate and perpendicular to the pivot shaft 95. The wider section also includes the passage 71E discharge; thus as shown, the passage 71E discharge is proximate to the pivot shaft 95.

Figure 15A:
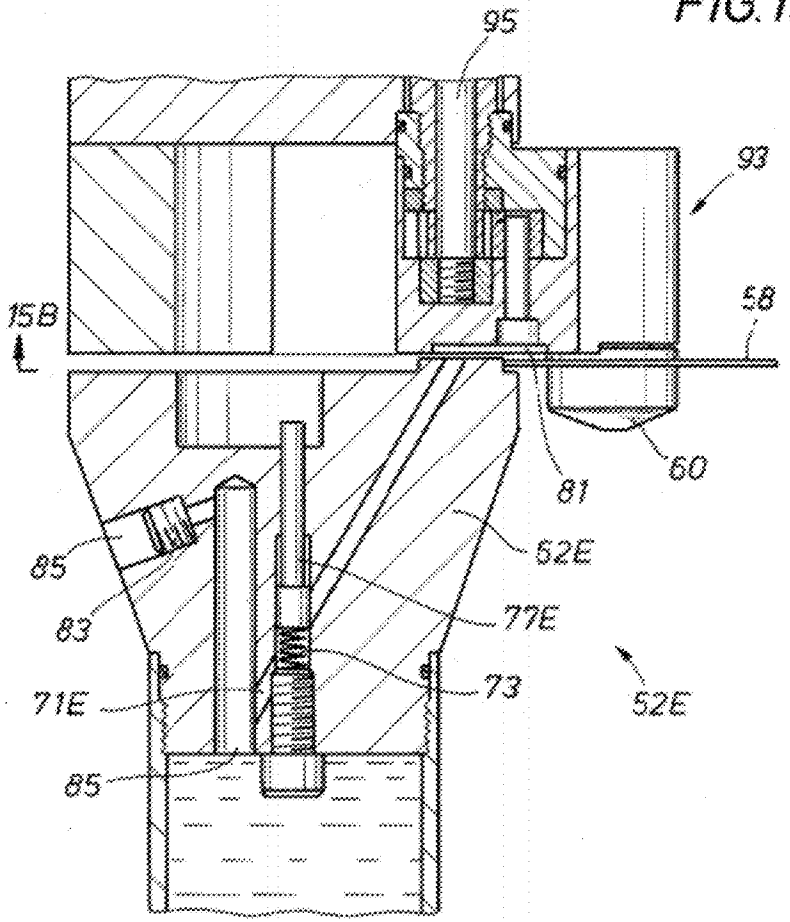
Figure 15B:
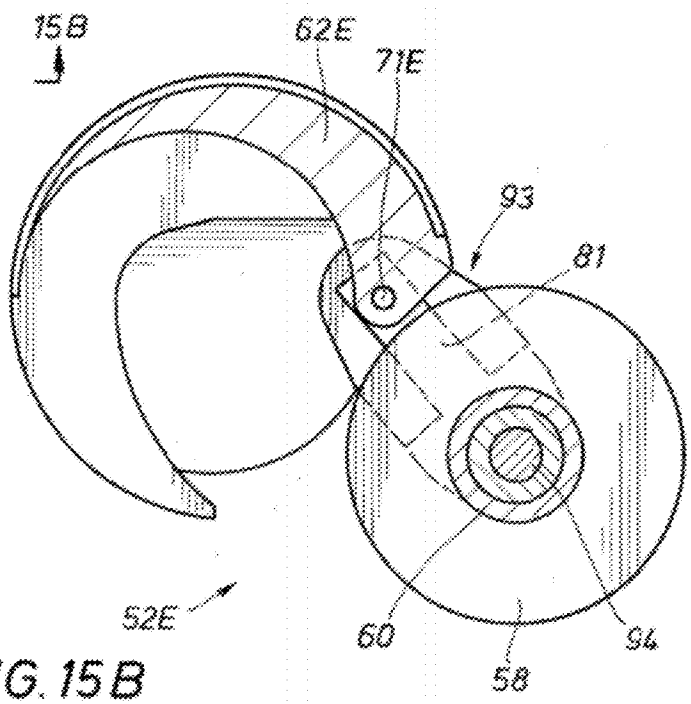

FIGS. 15A and 15B provide side and axial sectional views of the cutting tool 52E in a cutting position. The section of the nose portion 62E extending past the blade 58 encircles less than half the blade 58; this leaves an open space allowing the blade 58 to pivot radially outward into cutting contact with a tubular. Because the passage 71E discharge is aligned with the pivot shaft 95, the passage 71E remains registered with the channel 81 while the blade mount 93 and blade 58 are being pivoted into cutting contact. Thus as the blade 58 spins during a cutting procedure, grease and/or lubricant can be deposited on its side and delivered to the cutting surfaces such as by the centrifugal force of the blade 58.

The improvements described herein, therefore, are well adapted to carry out the objects and attain the ends and advantages mentioned, as well as others inherent therein. While presently preferred embodiments have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A cutting tool for cutting a downhole tubular, the cutting tool comprising:

a housing;

a cutting member having a stowed position within the housing and a cutting position in cutting contact with the tubular;

lubricant stored in a reservoir in the housing;

a lubricant dispensing system having an inlet in fluid communication with the reservoir;

an exit on the lubricant dispensing system that is sealed when the cutting member is in the stowed position, and opened by moving the cutting member into the cutting position, so that when the cutting member is in the cutting position lubricant can flow from the reservoir, through the lubricant dispensing system, and from the exit into the space between the cutting member and the downhole tubular; and a conveyance member suspended from the surface and comprising a lower end attached to the housing, a motor in the housing coupled to the cutting member, and an anchor coupled with the housing, and selectively positioned in a deployed configuration in anchoring contact with the tubular.

2. The cutting tool of claim 1, further comprising a pressure source in pressure communication with the lubricant in the reservoir, so that when the exit on the lubricant dispensing system is open the lubricant is urged from the reservoir and out the exit.

3. The cutting tool of claim 1, further comprising isolation material in a reservoir in the housing, a selectively openable passage between the reservoir and annulus between the cutting tool and the tubular, so that when the passage is opened the isolation material flows from the reservoir into the annulus to form a barrier hindering the lubricant from flowing away from the area where the cutting member contacts the tubular.

4. The cutting tool of claim 1, wherein the lubricant dispensing system comprises a conduit between the inlet and exit, a fastener coaxially coupled with the cutting member, wherein the exit mates with the fastener when the cutting member is in the stowed position to form a seal at the exit, and when the cutting member is in the cutting position the fastener is moved away from the exit thereby removing the seal from the exit allowing lubricant to flow through the conduit and out of the exit.

5. The cutting tool of claim 4, further comprising a sealing plug slidingly disposed within the conduit that forms a seal in the conduit along its length and is pushed from the conduit by the lubricant when the seal is removed.

6. The cutting tool of claim 1, wherein the lubricant dispensing system comprises a frangible conduit having an inlet in fluid communication with the reservoir, wherein the conduit is positioned so that when the cutting member moves from its stowed position to its cutting position it cutting contacts the frangible conduit to form an opening for lubricant to exit.

7. The cutting tool of claim 1, wherein the lubricant dispensing system comprises a conduit depending from the exit, a sealing surface in the conduit, a seal element in the conduit in selective sealing engagement with the sealing surface, a portion of the seal element protruding past the exit and in the cutting member path as it moves from its stowed to cutting position, so that when the cutting member moves into its cutting position it contacts the seal element to push it away from the sealing surface to provide a fluid communication path between the reservoir and the exit.

8. The cutting tool of claim 7, further comprising a resilient member in the conduit to urge the seal element against the sealing surface thereby maintaining a seal between the seal element and sealing surface.

9. The cutting tool of claim 1, wherein the lubricant dispensing system comprises a bore, a passage having an end in fluid communication with the reservoir and another end defining a lubricant exit proximate the cutting member, a seal plug in the bore wedged between a resilient member and fastener bottom and slideable from a first position that blocks flow through the passage to a second position away from the passage, and a notch on the seal plug outer surface, so that when the cutting member moves into its cutting position it contacts the seal plug to fracture it at the notch allowing the resilient member to expand and push the seal plug from its first to its second position.

10. The cutting tool of claim 1, wherein the lubricant dispensing system comprises a blade mount having the cutting member mounted on one end, pivotingly attached to the housing on its opposite end, and moveable from a stowed into a cutting position, a channel on the mount having an inlet and an exit facing a side of the cutting member opposite the reservoir, and a selectively openable passage having an end in fluid communication with the reservoir and another end in fluid communication with the channel inlet, so that when the passage is open lubricant flows from the reservoir, through the passage, into the channel inlet, and from the channel exit onto a side of the cutting member opposite the reservoir.

11. The cutting tool of claim 1, further comprising an electrical power supply at the surface connected to the conveyance member and a conducting member between the conveyance member and the motor, so that power from the electrical power supply powers the motor.

12. A method of cutting a downhole tubular comprising:

a) providing a tubular cutting device that includes a body, a cutting member moveable along a path from a stowed position within the body to a cutting position outside of the body, a supply of lubricant in the body, a lubricant dispensing system in fluid communication with the lubricant and comprising a selectively openable exit that is in sealing contact with a portion of the cutting member when the cutting member is in the stowed position and is open when the cutting member is in the cutting position;

b) deploying the cutting device within the tubular;

c) contacting the portion of the dispensing system with the cutting member by moving the cutting member from the stowed position to the cutting position;

d) selectively opening the dispensing system exit by the step of moving the cutting member from the stowed position to the cutting position so that lubricant flows from the exit and in the space adjacent the portion of the tubular to be cut;

e) rotating the cutting member;

f) contacting the tubular with the rotating cutting member with the lubricant between the cutting member and the tubular; and g) moving the cutting member from the stowed to the cutting position thereby opening the dispensing system exit and urging lubricant through the dispensing system and out the exit so that the lubricant flows between the cutting member and the tubular.

13. The method of claim 12, wherein at least a portion of the dispensing system is in the cutting member path.

14. The method of claim 13, wherein the lubricant dispensing system includes a frangible conduit having an inlet in fluid communication with the reservoir, the method further comprising moving the cutting member from its stowed position to its cutting position thereby cutting the frangible conduit to form an opening for lubricant to exit and urging lubricant through the dispensing system and out the exit so it is flowable between the cutting member and the tubular.

15. The method of claim 13, wherein the lubricant dispensing system includes a conduit depending from the exit, a sealing surface in the conduit, a seal element in the conduit in selective sealing engagement with the sealing surface, a portion of the seal element protruding past the exit defining the portion of the dispensing system in the cutting member path the method further comprising:

moving the cutting member from its stowed to its cutting position into contact with the seal element thereby pushing the seal element away from the sealing surface and providing a fluid communication path between the reservoir and the exit; and urging lubricant through the dispensing system and out the exit so it is flowable between the cutting member and the tubular.

16. The method of claim 15, further comprising providing a resilient urging force onto the seal element pushing it towards the sealing surface, so that when the cutting blade is not in contact with the seal element a seal is formed between the seal element and the sealing surface.

17. The method of claim 12, wherein step (d) is performed using the cutting member.

18. The method of claim 12, wherein step (d) further comprises flowing lubricant on a side of the cutting member opposite the reservoir.

19. The method of claim 12, further comprising pressurizing the supply of lubricant in the body, so that when the exit is open the lubricant can flow through the lubricant dispensing system and out of the exit.

20. The method of claim 12, further comprising providing a motor in the housing having an output coupled to the cutting member, electrically connecting the conveyance member and the motor, electrically connecting the conveyance member to a surface mounted power supply, and selectively powering the motor with the surface mounted power supply.

21. A cutting tool for cutting a tubular comprising:

a housing;

a motor in the housing;

a supply of lubricant in the housing;

a cutting blade rotatable by the motor and extendable from within the housing into cutting contact with the tubular inner surface; and a means for conveying the lubricant from within the housing to the tubular inner surface where it is contacted by the cutting member that is operable when the cutting member extends into cutting contact with the tubular inner surface.

22. The cutting tool of claim 21, wherein the tubular and the cutting tool are disposed in a wellbore, and the cutting tool further comprises a conveyance member connected on its lower end to the housing and on its upper end to a power supply above the wellbore.

* * * * *